US011243058B2

(12) United States Patent
Choiniere et al.

(10) Patent No.: US 11,243,058 B2
(45) **Date of Patent: *Feb. 8, 2022**

(54) ACCURATE RANGE-TO-GO FOR COMMAND DETONATION

(71) Applicant: BAE SYSTEMS Information and Electronic Systems Integration Inc., Nashua, NH (US)

(72) Inventors: Michael J. Choiniere, Merrimack, NH (US); Bruce Winker, Weaverville, NC (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 681 days.

This patent is subject to a terminal disclaimer.

(21) Appl. No.: 16/123,202

(22) Filed: Sep. 6, 2018

(65) Prior Publication Data

US 2020/0080826 A1 Mar. 12, 2020

(51) Int. Cl.

| | |
|---|---|
| ***F42C 13/02*** | (2006.01) |
| ***F41G 7/22*** | (2006.01) |
| ***F42C 13/04*** | (2006.01) |

(52) U.S. Cl.

CPC ..... *F42C 13/023* (2013.01); *F41G 7/2286* (2013.01); *F41G 7/2293* (2013.01); *F42C 13/04* (2013.01)

(58) Field of Classification Search

CPC ..... F42B 15/01; F42B 15/00; F42B 12/365; F42B 30/00; F42B 30/006; F42B 30/08; F41G 7/2286; F41G 7/30; F41G 7/22; F41G 7/226; F41G 7/2266; F42C 13/04; F42C 11/06; F42C 11/065; F42C 11/04

See application file for complete search history.

(56) References Cited

U.S. PATENT DOCUMENTS

| | | | | |
|---|---|---|---|---|
| 6,378,435 | B1 * | 4/2002 | Bai | F42C 11/06 102/206 |
| 7,533,849 | B2 | 5/2009 | Zemany et al. | |
| 7,999,212 | B1 | 8/2011 | Thiesen et al. | |
| 8,450,668 | B2 | 5/2013 | Maynard et al. | |
| 9,683,814 | B2 | 6/2017 | Dryer | |
| 10,466,024 | B1 | 11/2019 | Choiniere et al. | |
| 10,533,831 | B1 | 1/2020 | Choiniere et al. | |
| 10,775,143 | B2 | 9/2020 | Choiniere et al. | |
| 10,962,990 | B2 * | 3/2021 | Choiniere | F41G 7/36 |
| 2020/0080824 | A1 | 3/2020 | Choiniere et al. | |
| 2020/0081025 | A1 * | 3/2020 | Choiniere | F42B 12/365 |
| 2021/0041897 | A1 * | 2/2021 | Choiniere | F41G 7/28 |

* cited by examiner

*Primary Examiner* — Benjamin P Lee
(74) *Attorney, Agent, or Firm* — KPIP Law, PLLC; Scott J. Asmus

(57) ABSTRACT

The system and method for accurately determining range-to-go for the command detonation of a projectile. Using dual laser and/or radio frequency detectors on the tail and on the nose of a spinning projectile to determine the range-to-go, time-to-go, or lateral offset from the projectile to the target.

20 Claims, 4 Drawing Sheets

ACCURATE RANGE-TO-GO FOR COMMAND DETONATION

FIELD OF THE DISCLOSURE

The present disclosure relates to guided munitions and more particularly to a system and method for accurately determining range-to-go for command detonation of a projectile.

BACKGROUND OF THE DISCLOSURE

Precise command detonation maximizes the warhead effects against a target and is highly depended on the "range to go" or "time to go" prior to or after impact. Depending on the target and the warhead fragment pattern there is an optimum distance in front of the target for soft target (UAS, aircraft, combatants, etc.). For structures, a distance "after" the target, or a delayed detonation, may be useful when flight through a window is preferred, for example. In either case, knowing the time accurately has been difficult. Many simple rounds have used spin counters and by knowing the target range and the number of revolution/meter from the projectile rifling, one can program the round to detonate after a particular spin count. However, these and other conventional techniques rely on knowing the range to extreme accuracy prior to launch and are totally ineffective for moving targets. What is typically lacking is an architecture that measures the "time-to-go" to the actual target and thereby improves accuracy.

Wherefore it is an object of the present disclosure to overcome the above-mentioned shortcomings and drawbacks associated with conventional guided munitions.

SUMMARY OF THE DISCLOSURE

One aspect of the present disclosure is a system comprising of a radio frequency (RF) or laser short energy pulse (10 to 100 ns) that illuminates a projectile's rear sensor and one or more targets. The energy of the short energy pulse is reflected off the target and is received by a second sensor on the nose of the projectile. The first sensor detects the pulse energy as it passes by the projectile, generating a $T_{zero}$ (i.e., the start of a range finding clock). The clock is stopped when the target's reflected energy is detected by the second sensor at $T_{reflected}$. The time differential represents the round trip time between the projectile and the target which can be converted to a range.

In one embodiment of the system of the present disclosure, the system uses the measured RF or laser energy detection from sensor 1 and sensor 2 in a simple limit trip switch approach. When the time-to-go is time <0.0015 seconds, or the like, it will detonate. In certain embodiments, the time is dependent on the projectile speed, warhead ideal detonation distance, and other factors. The "time-to-go" could be a time variable programmed at launch and/or could be negative (e.g., when flying through a window).

Another embodiment of the present disclosure determines the lateral offset between the projectile's trajectory and the target's actual position (i.e., a lateral miss distance). In this embodiment, the projectile's rear sensor(s) can determine the projectile's velocity by measuring the time increase between each pulse interval. The time base of each illumination pulse or the pulse repetition interval (PRI) serves as means to measure the time expansion between pulse intervals. If the projectile was not moving, the PRI would match the expected PRI. For a 40 Hz system, the PRI is 25 milliseconds, a projectile at MACH 3 would travel 25 meters. The 25 meters→81 feet→81 nanosecond (speed of light) increases the PRI time base which can be measured and tracked. By convolving the velocity with the "time-to-go," one can determine the lateral offset, thereby improving/optimizing the accuracy of the detonation.

Yet another aspect of the present disclosure is A guided projectile, comprising; a tail sensor located on a tail portion of the guided projectile for detecting a laser or radio frequency signal; a forward sensor located on a forward portion of the guided projectile and detecting a reflected laser or radio frequency signal from a target; a computer readable storage device having instructions, which when executed by a processor, cause the processor to execute: determining a first time at which the laser beam is detected via the tail detector; determining a second time at which the reflected signal is detected via the front detector; comparing the first time to the second time to determine a time delay; determining an azimuth and an elevation of the guided projectile based on the detected laser or radio frequency signal by the tail detector; and determining one or more of the following using the time delay between detection by the tail detector and detection by the front detector: a lateral offset between the projectile and the target; a time-to-go for the projectile to reach the target; and a range-to-go for the projectile to reach the target.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1A:
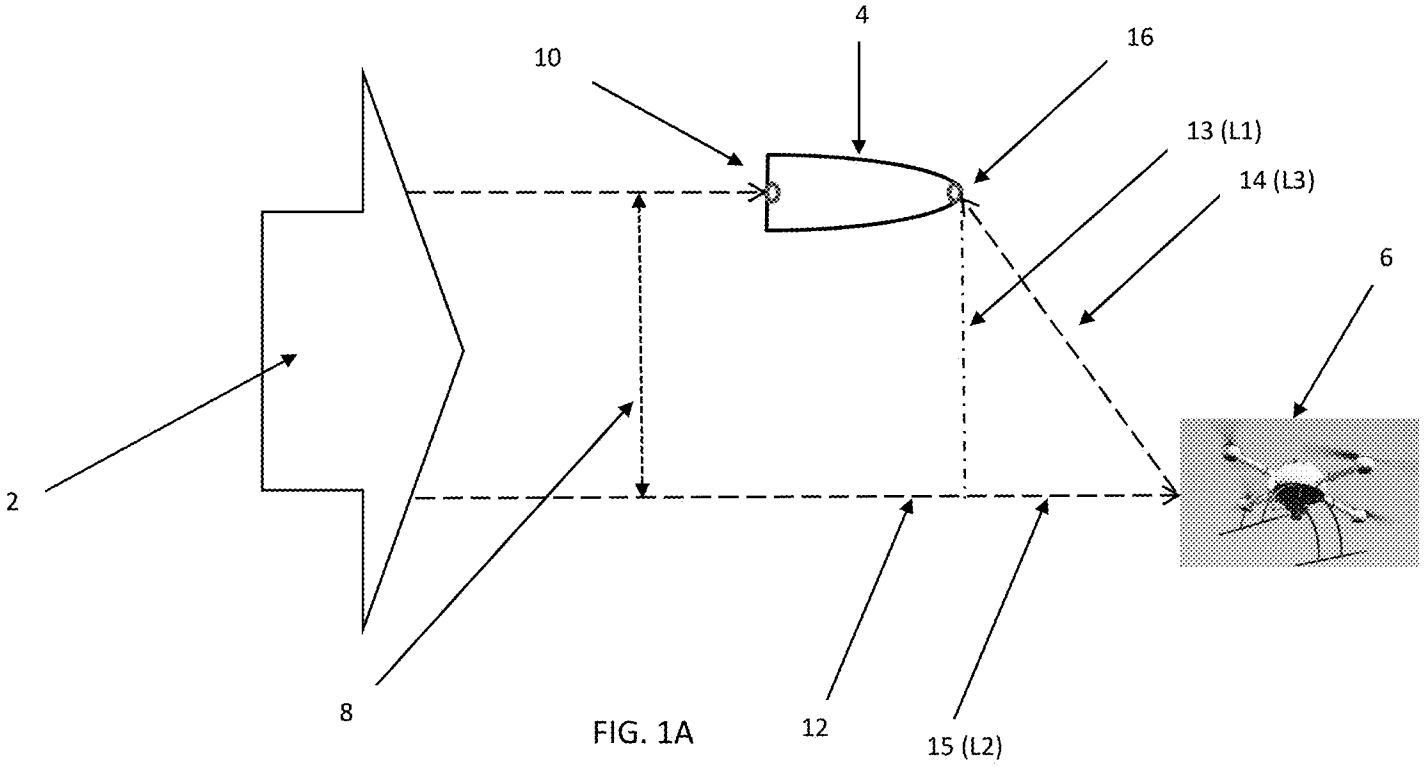
FIG. 1A shows one embodiment of the range-to-go system of the present disclosure.

One embodiment of the present disclosure is a system for accurately determining the range-to-target distance for a guided munition. In one embodiment, the accuracy is within less than a meter. In some cases, the system utilizes a low energy, short pulse laser (e.g., fiber laser) or radio frequency pulse to paint a target. The short pulse can be about 1 to about 50 nanoseconds depending on the transmitter. In some cases, the system is low power since the path is one way from the illuminator to the projectile. In certain embodiments, low energy is about 100 μJoules per pulse.

In certain embodiments, munitions are laser guided. There, a target is illuminated, or "painted," by a laser target designator on the ground or on an aircraft. One disadvantage of laser guided munitions is in poor weather the system may not be useable because the target illumination cannot be seen, or if the target designator cannot get near the target. In certain embodiments, a laser designator sends a beam in a coded series of pulses so the munition can identify the proper signals, and that way multiple designators can operate in the same region.

In certain embodiments, the munitions are guided with radio control. In some cases, an aircraft transmits control signals to the munition to guide it to the target. In some cases, the RF or laser signal emanates from a plane or vehicle weapons fire control system. The fire control system guides the weapon to the target using the RF, EO, or a combination of the two modalities and illuminates the target during the terminal end game or the region near the target.

In certain embodiments, the target may be large and fixed, but in other embodiments the target may be a small, moving target or something in between. In one embodiment, the target is an unmanned vehicle, such as a drone. In one embodiment, the target is vehicle, such as an air or land vehicle. In one embodiment, the target is building.

In certain embodiments of the system of the present disclosure, a spinning projectile, or munition, is guided to the target from a tracking station. In some cases, a tracking station may be on the ground, such as part of command and control. In some cases, the tracking station may be on a vehicle. In certain embodiments, the munition is guided by a fire control system on the launch platform.

In some cases, the munition is spinning at 5-20 k revolutions/second. In some cases, the munition is a fly-by projectile that has a directional blast pattern that necessitates accurate detonation in order to hit the target as accurately as possible while mitigating unintended hits or misses. In some embodiments, the blast pattern may be about 1-20 m wide.

In some embodiments, the fiber laser, or the like, is used to emit radiation to paint the target and/or to track the munition. In some cases, the emitted radiation is used to provide an azimuth (Az) and an elevation (El) bearing for the projectile relative to the target. In some cases, the radiation will hit the back of the projectile and reflect back to the tracking station, or the like. In some cases, the tracking station reports only the Az and El position for the projectile, thus simplifying the electro-optical (EO)/radio frequency (RF) system used in the present command detonation system.

One embodiment of the present disclosure is to mount a pin diode/antenna, or the like, on the rear of and on the face of the projectile. The rear facing detector/antenna generates a time zero ($T_{zero}$) and as well as Az and El information for the projectile. In certain embodiments, a laser return off the projectile, which is detected by the detector on the face of the projectile, generates the range-to-go to the target. This method eliminates the need to determine the range at the tracking station, thus reducing the cost of the scanner and the peak power of the laser or RADAR used to paint the target.

In some cases, the system also eliminates the complex latency of the tracking system since the projectile acts as its own reference. By using the same laser or radio output, and mounting a pair of receivers on the munition, the losses are reduced from $R^4$ and approach $R^2$ losses. In a traditional system, where the fire control system uses RADAR or LIDAR to track the projectile and the target, the losses are in terms or range$^4$ or $R^4$. The energy goes out to both target and projectile generating $R^2$ losses in the outgoing and then in the return energy; thereby producing $R^4$ losses. The single path ($R^2$) could reduce the power need from megawatts to kilowatts or reduce the power needed by the square root of the power needed for a RADAR or LIDAR. This assumes first order and neglects environmental losses.

Since unmanned aircraft are very small, LIDAR and RADAR are ineffective at generating range-to-go for a projectile to the target due to the small signatures of the targets. By tracking them with EO sensors at the fire control system, the azimuth (Az) and elevation (El) of the target can be determined. There, range remains difficult given the weak return signal, but the projectile can still be launched and guided to the target using a version of line of sight (LOS) command guidance. As the projectile approaches the target, the weak signal goes from $R^4$ at the beginning of the flight to $R^2$ prior to target contact. Even a weak signal is detected with the system of the present disclosure since the receiver in now on the projectile.

Referring to FIG. 1A, one embodiment of the disclosure is shown. More specifically, a laser pulse and/or an RF pulse 2 is propagated in the direction of a target 6 and a projectile or guided munition 4. The laser pulse and/or RF pulse is used to determine the Az and El of the projectile by detecting reflected signals with sensors located on the projectile. The error 8 associated with the Az and El data is determined by a Fire Control EO/RF subsystem. In some cases, the Fire Control subsystem is located on the projectile's launch platform. In certain embodiments, a detector mounted on the rear of the projectile 10 detects the laser pulse and/or RF pulse and establishes a time zero ($T_{zero}$). In some cases, the laser pulse and/or RF pulse is reflected off the target 14 and is detected by a detector proximate the front 16 of the munition/projectile.

Still referring to FIG. 1A, determining the time delay between the detection of the radiation signal at the tail 10 of the munition 4 and the detection of the reflected radiation signal off the target by the detector on the front portion of the munition 16, allows a range-to-go to be calculated. This approach also allows the projectile 4 to know its lateral offset from the target 13 (L1). In some embodiments, the lateral offset is determined by the Fire Control system and the time-to-go is determined from the laser/RF pulse. By using the time delay calculated from the differential path 12, an accurate detonation time can be set. In other words, a first signal is detected by the tail 10 detector and a second signal is detected by the front 16 detector located on the front of the projectile as the signal is reflected back from the target.

Figure 1B:
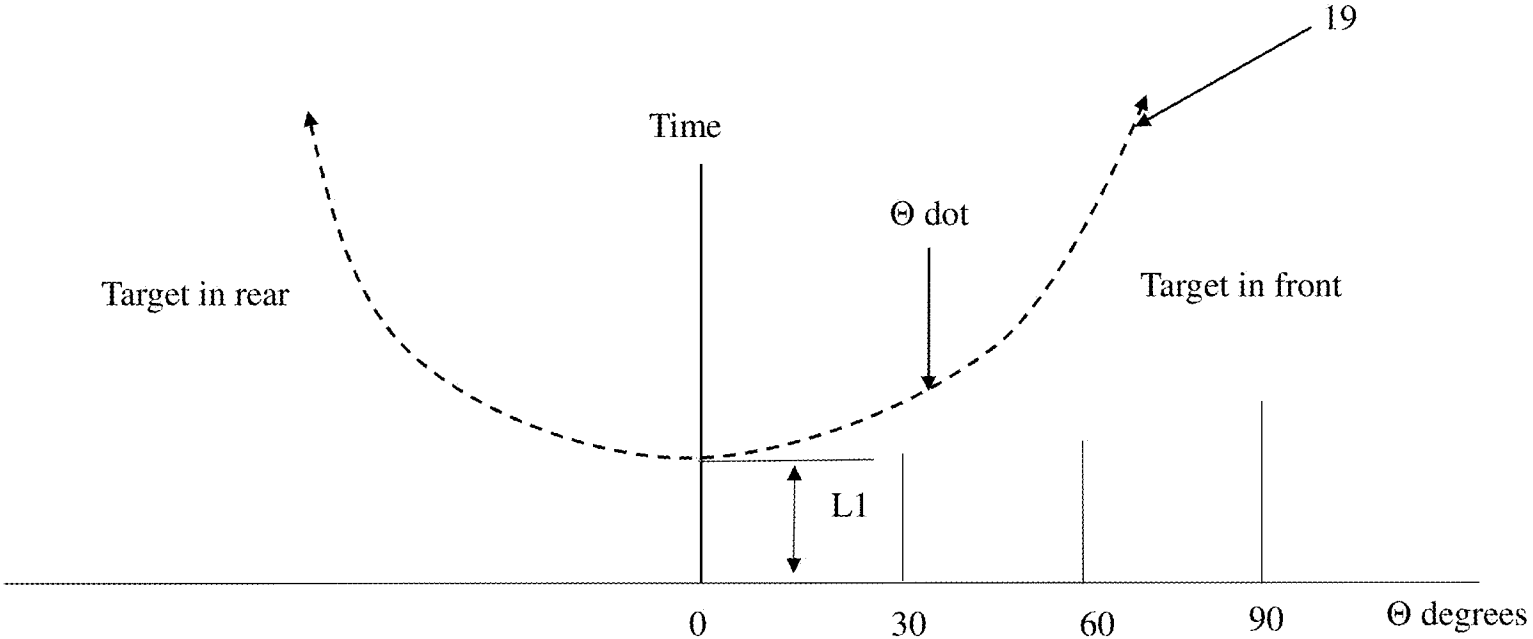
FIG. 1B shows calculations for range-to-go, lateral offset, and the like according to the principles of the present disclosure.

Referring to FIG. 1B, the calculations for range-to-go, lateral offset, and the like according to the principles of the present disclosure are shown. More specifically, a plot of theta, θ, against time is shown. The lateral offset L1 is shown. There is it possible to see that as the projectile (e.g. munition) flies over the target, the distance and thus the time from the munition 19 is asymptotic such that the curve goes from 0° when the projectile is directly over the target and approaches 90° when the projectile is about 20 to 50 meters away from the target, ignoring the length of the munition. At that point, as shown in FIG. 1A, it would be near linear (L2=L3) and L1 would come into play and be a minor contributor. Where sin Θ=L2/L3, Time=L2+L3 (ignoring the weapon length); L3=time/(sin Θ+1) and L2=sin Θ*L3.

In certain embodiments, the front and/or rear detectors are EO PIN diodes. In some cases, the forward looking detector is an RF antenna. An RF sensor has the advantage of being all weather, but the RF sensor has the disadvantage of large beams ~2-3° or larger depending on the application. In a UAV swarm environment RF provides large area coverage for a lower cost, than electro-optical (EO) systems. EO systems using laser or narrow beam illuminators can direct the energy at longer distances to a specific target feature; a wall on a building, a door, a window, etc. The spatial control of some weapon systems may gravitate to an EO system for higher precision.

Figure 2:
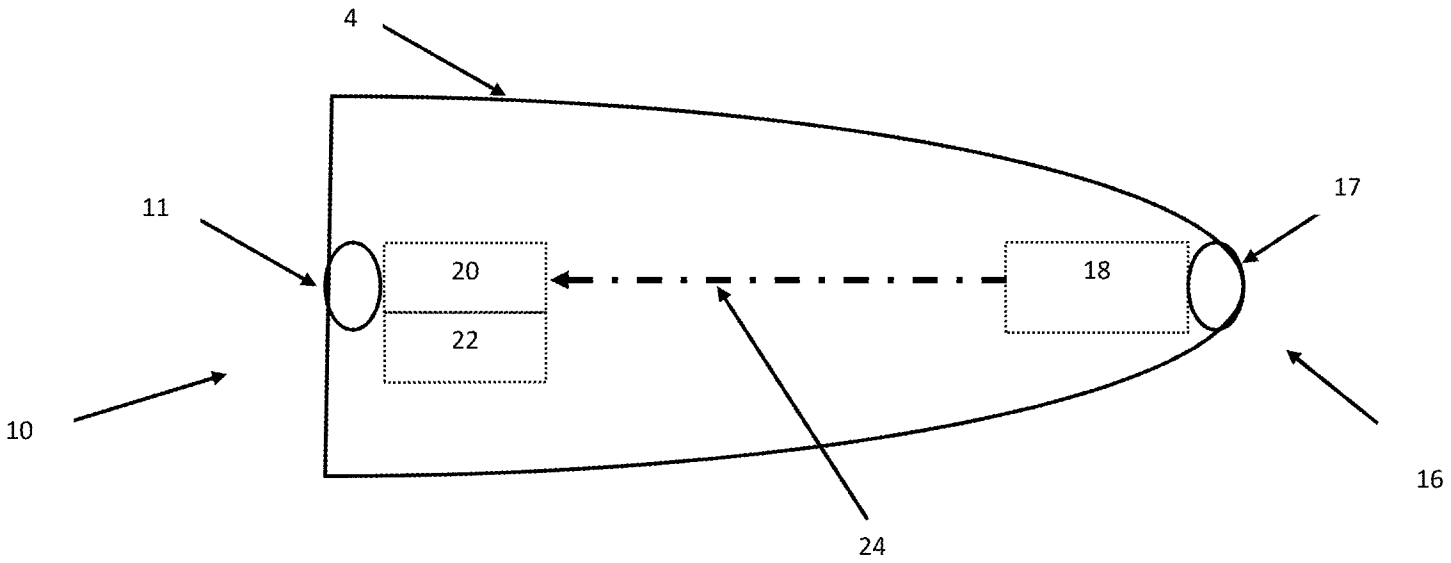
FIG. 2 illustrates two sensors with detector electronics and an associated processor on a munition according to the principles of the present disclosure.
Figure 3:
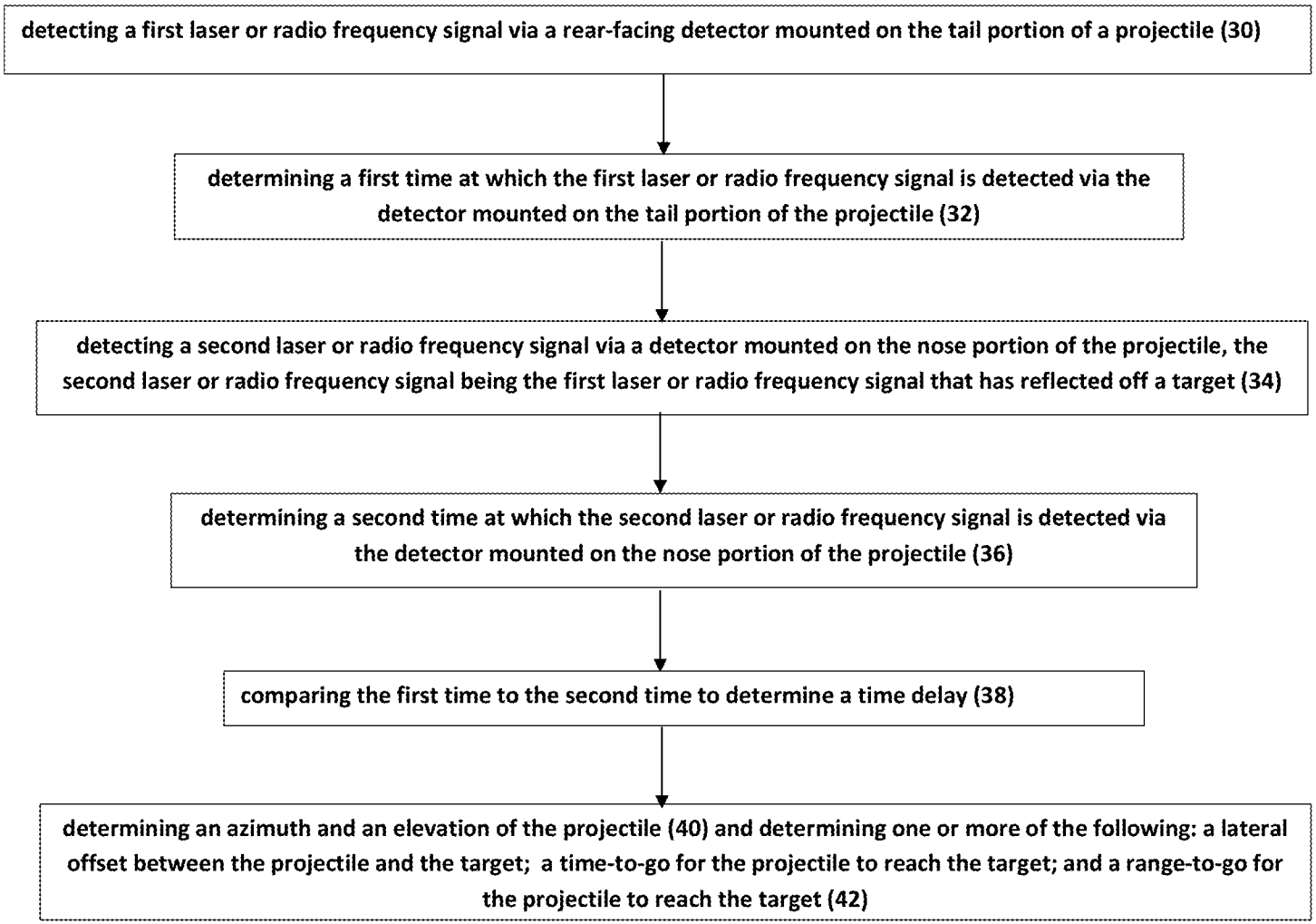
FIG. 3 shows a flowchart of one embodiment of a method according to the principles of the present disclosure.

Referring to FIG. 2, the construct of the two sensors located on the guided munition according to the principles of the present disclosure is shown. The munition could be a guided projectile from a 0.5 caliper sniper round to a 1255 mm artillery shell. The guidance package could be spinning with respect to the ordnance or could be roll stabilized using a bearing between the ordnance the guidance package. In some cases, the time to measure can be accomplished by the elements shown in FIG. 2. More specifically, a forward-facing detector 17, may comprise an RF antenna, an EO with one or more lenses, or the like. In some cases, the rear-facing detector 11 may be one or more detectors, where the detector is an RF antenna, an EO with one or more lenses, or the like. In certain embodiments, the front detector electronics 18 is in communication 24 with the rear detector electronics 22 and a processor 22. In some cases, the communication link may be a cable, a magnetic inductance link, an RF link, an optical link, or the like. Referring to FIG. 3, a flowchart of one embodiment of a method according to the principles of the present disclosure is shown. More specifically, the system detects a first laser or radio frequency signal via a rear-facing detector mounted on the tail portion of a projectile (30) and determines a first time at which the first laser or radio frequency signal is detected via the detector mounted on the tail portion of the projectile (32). The system detects a second laser or radio frequency signal via a detector mounted on the front portion of the projectile, the second laser or radio frequency signal being the first laser or radio frequency signal that has reflected off a target (34) and determines a second time at which the second laser or radio frequency signal is detected via the detector mounted on the nose portion of the projectile (36). The system compares the first time and the second time to determine a time delay (38). Next, by determining an azimuth and an elevation of the projectile (40) and determining one or more of the following: a lateral offset between the projectile and the target; a time-to-go for the projectile to reach the target; and a range-to-go for the projectile to reach the target (42) improved guidance is provided.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A method for guiding a projectile, comprising:

providing a projectile comprising a tail portion and a nose portion;

detecting a first laser or radio frequency signal via a tail detector mounted on the tail portion of the projectile;

determining a first time at which the first laser or radio frequency signal is detected via the tail detector mounted on the tail portion of the projectile;

detecting a second laser or radio frequency signal via a forward detector mounted on the nose portion of the projectile, the second laser or radio frequency signal being the first laser or radio frequency signal that has reflected off a target;

determining a second time at which the second laser or radio frequency signal is detected via the forward detector mounted on the nose portion of the projectile;

comparing the first time to the second time to determine a time delay;

determining an azimuth and an elevation of the projectile based on the detection of the first laser or radio frequency signal via the tail detector mounted on the tail portion of the projectile; and determining one or more of the following using the time delay between detection by the tail detector and detection by the forward detector: a lateral offset between the projectile and the target; a time-to-go for the projectile to reach the target; and a range-to-go for the projectile to reach the target.

2. The method for guiding a projectile according to claim 1, wherein one or both of the tail detector on the tail of the projectile and the forward detector on the nose of the projectile is an electro-optical PIN diode.

3. The method for guiding a projectile according to claim 1, wherein one or both of the tail detector on the tail of the projectile and the forward detector on the nose of the projectile is a radio frequency antenna.

4. The method for guiding a projectile according to claim 1, wherein the forward detector on the nose of the projectile is a radio frequency antenna and the tail detector on the tail of the projectile is an electro-optical PIN diode.

5. The method for guiding a projectile according to claim 1, wherein a range finding clock is started when the first signal is detected ($T_{zero}$) by the detector on the tail of the projectile and the range finding clock is stopped when the second signal is detected by the front detector on the nose of the projectile ($T_{reflected}$), thereby creating a time differential that represents a round trip time between the projectile and the target which can be converted to a range-to-go.

6. The method for guiding a projectile according to claim 1, wherein a range finding clock is started when the first signal is detected ($T_{zero}$) by the tail detector on the tail of the projectile and the range finding clock is stopped when the second signal is detected by the forward detector on the nose of the projectile ($T_{reflected}$), thereby creating a time differential that represents a round trip time between the projectile and the target which can be used as a time-to-go, or limit trip switch.

7. The method for guiding a projectile according to claim 6, wherein when the time-to-go is about 0.0015 seconds, sending a signal to the projectile to cause the projectile to detonate.

8. The method for guiding a projectile according to claim 6, wherein the time-to-go determination is dependent on the projectile speed and the detonation time-to-go is programmed at the time of launch.

9. The method for guiding a projectile according to claim 6, wherein the time-to-go value is negative.

10. The method for guiding a projectile according to claim 1, wherein the first signal further comprises a first pulse repetition interval and the second signal further comprises a second pulse repetition interval.

11. The method for guiding a projectile according to claim 1, wherein the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

12. A guided projectile, comprising;

a tail detector located on a tail portion of the guided projectile for detecting a laser or radio frequency signal;

a forward detector located on a forward portion of the guided projectile for detecting a reflected laser or radio frequency signal from a target;

a computer readable storage device having instructions, which when executed by a processor, cause the processor to execute:

determining a first time at which the laser or radio frequency signal is detected via the tail detector;

determining a second time at which the reflected laser or radio frequency signal is detected via the forward detector;

comparing the first time to the second time to determine a time delay;

determining an azimuth and an elevation of the guided projectile based on the detected laser or radio frequency signal; and determining one or more of the following using the time delay between detection by the tail detector and detection by the forward detector: a lateral offset between the projectile and the target; a time-to-go for the projectile to reach the target; and a range-to-go for the projectile to reach the target.

13. The guided projectile of claim 12, wherein at least one of the tail detector and the forward detector is an electro-optical PIN diode.

14. The guided projectile of claim 12, wherein at least one of the tail detector and the forward detector is a radio frequency antenna.

15. The guided projectile of claim 12, wherein the tail detector is a radio frequency antenna and the forward detector is an electro-optical PIN diode.

16. The guided projectile of claim 12, wherein a range finding clock is started when the signal is detected ($T_{zero}$) by the tail detector and the range finding clock is stopped when the reflected laser or radio frequency signal is detected by the forward detector ($T_{reflected}$), thereby creating a time differential that represents a round trip time between the projectile and the target which can be converted to a range-to-go.

17. The guided projectile of claim 12, wherein a range finding clock is started when the signal is detected ($T_{zero}$) by the tail detector and the range finding clock is stopped when the reflected laser or radio frequency signal is detected by the forward detector ($T_{reflected}$), thereby creating a time differential that represents a round trip time between the projectile and the target which can be used as a time-to-go, or limit trip switch.

18. The guided projectile of claim 12, wherein when the time-to-go is about 0.0015 seconds, sending a signal to the projectile to cause the projectile to detonate.

19. The guided projectile of claim 12, wherein the azimuth and the elevation of the guided projectile is based on the detected laser or radio frequency signal by the tail detector.

20. A computer program product including one or more machine-readable mediums encoded with instructions that when executed by one or more processors cause a process to be carried out for projectile guidance with a projectile having a tail detector and a forward detector, the process comprising:

determining a first time at which a laser or radio frequency signal is detected via the tail detector;

determining a second time at which a reflected laser or radio frequency signal is detected via the forward detector;

comparing the first time to the second time to determine a time delay;

determining an azimuth and an elevation of a guided projectile based on the detected laser or radio frequency signal; and determining one or more of the following using the time delay: a lateral offset between the projectile and a target; a time-to-go for the projectile to reach the target; and a range-to-go for the projectile to reach the target.

* * * * *